US005226184A

United States Patent [19]

Cheng

[11] Patent Number: 5,226,184

[45] Date of Patent: Jul. 13, 1993

[54] FLOATABLE WAVE SUBDUING BLANKET

[76] Inventor: Chun-Ming Cheng, 2F, 55, Pin Teng Street, Hsin Dian, Taipei, Taiwan

[21] Appl. No.: 987,596

[22] Filed: Dec. 9, 1992

[51] Int. Cl.[5] ..... B03C 9/08; A47G 9/00

[52] U.S. Cl. ..... 5/417; 5/420; 5/481; 5/482; 441/129; 441/125; 441/45

[58] Field of Search ..... 5/417–420, 5/448, 449, 452, 481, 482, 486; 441/35, 44, 45, 125, 129–132, 136

[56] References Cited

U.S. PATENT DOCUMENTS

| | | | |
|---|---|---|---|
| 1,329,687 | 2/1920 | Underwood | 5/449 X |
| 1,624,797 | 4/1927 | Morehouse | 5/417 |
| 2,464,086 | 3/1949 | Hiscock | 441/35 |
| 3,380,088 | 4/1968 | D'Adesky | 441/129 X |
| 4,006,503 | 2/1977 | Wood | 441/129 |
| 4,137,584 | 2/1979 | Sharber | 5/417 |
| 4,181,990 | 1/1980 | Santo | 5/452 |
| 4,766,626 | 8/1988 | Green | 5/420 |
| 5,022,107 | 6/1991 | Knotts | 5/419 |
| 5,052,965 | 10/1991 | Klapp et al. | 5/420 X |

FOREIGN PATENT DOCUMENTS

| | | | |
|---|---|---|---|
| 359438 | 10/1931 | United Kingdom | 441/44 |
| 2075924 | 11/1981 | United Kingdom | 441/130 |

*Primary Examiner*—Michael F. Trettel

[57] ABSTRACT

A floatable wave subduing blanket made from cellular low density polyethylene in a rectangular shape having a plurality of cylindrical inflatable floats detachably fastened to the four sides thereof. The cylindrical inflatable floats subdue water waves as the blanket floats on the water for carrying a person.

2 Claims, 3 Drawing Sheets

FLOATABLE WAVE SUBDUING BLANKET

BACKGROUND OF THE INVENTION

The present invention relates to a floatable wave subduing blanket which can be used as a blanket for keeping the body warm or a beach mattress for carrying a person on the water.

In playing water sports, a beach mattress may be used for carrying a person on the water. Because a regular beach mattress does not have wave subduing structure, it can not weather big waves. Furthermore, a beach mattress may be used as a bed for sleeping but can not be used as a covering for keeping the body warm.

SUMMARY OF THE INVENTION

The present invention has been accomplished under the aforesaid circumstances. It is therefore an object of the present invention to provide a floatable wave subduing blanket which can be used as a floating bed or life preserver to carry a person on the water. It is another object of the present invention to provide a floatable wave subduing blanket which can be used as a covering for keeping the body warm. It is still another object of the present invention to provide a floatable wave subduing blanket which can weather big waves as floated on the water. It is still another object of the present invention to provide a floatable wave subduing blanket which is lightweight, simple in structure, and easy to carry. It is still another object of the present invention to provide a floatable wave subduing blanket which is inexpensive to manufacture.

According to the present invention, a floatable wave subduing blanket is generally comprised of a rectangular blanket body made from cellular low density polyethylene, and a plurality of cylindrical floats detachably fastened to said blanket around the four sides thereof. The cylindrical floats may be respectively made in a hollow, solid structure or an inflatable structure. Plastic bolts are formed on a flat board on each cylindrical float for detachably connect to the blanket body through a respective plug-in connection.

DETAILED DESCRIPTION OF THE PREFERRED EMBODIMENT

Figure 1:
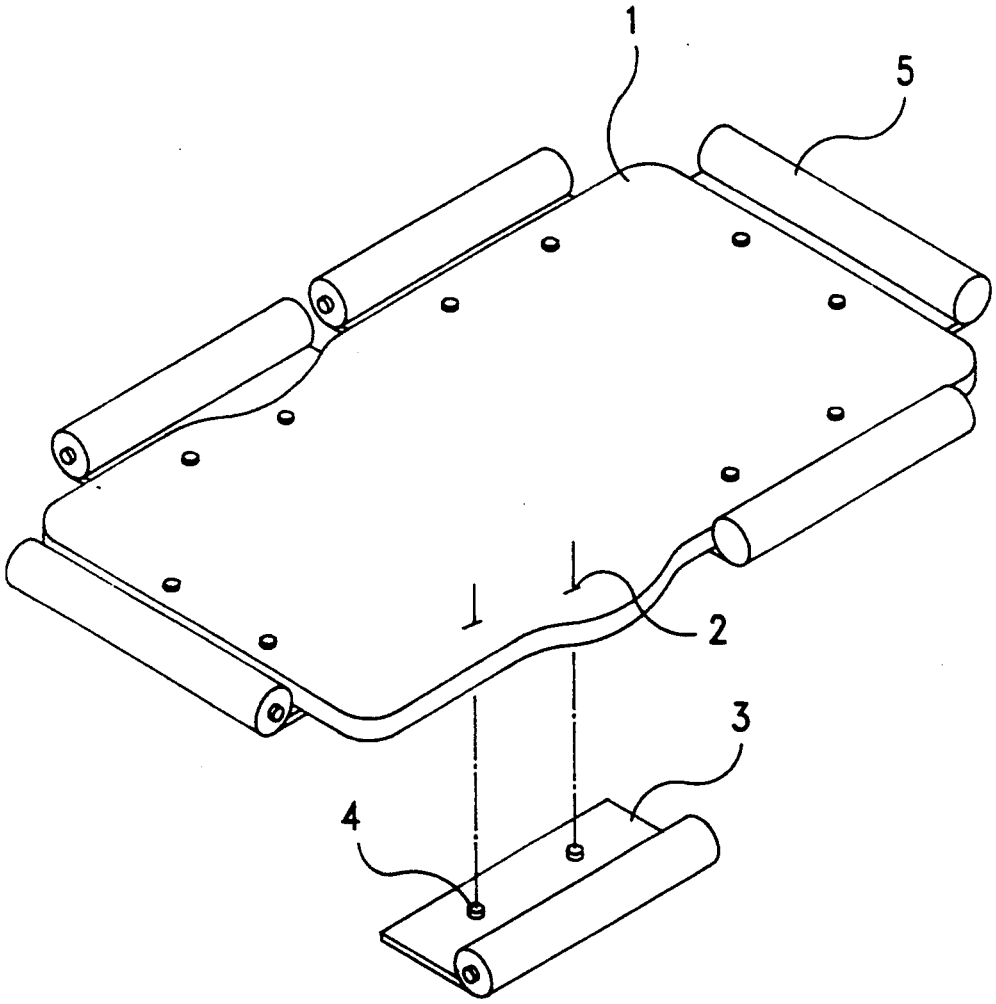
FIG. 1 is an elevational and partly exploded view of a blanket embodying the present invention.
Figure 2:
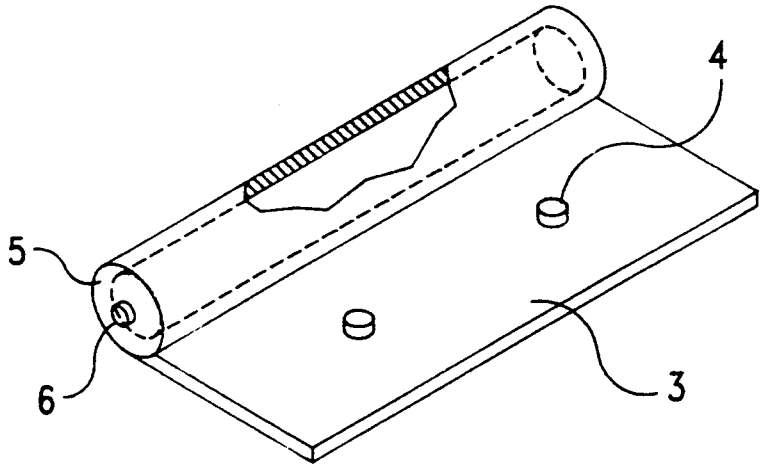
FIG. 2 is a perspective view of a float according to the present invention.
Figure 3:
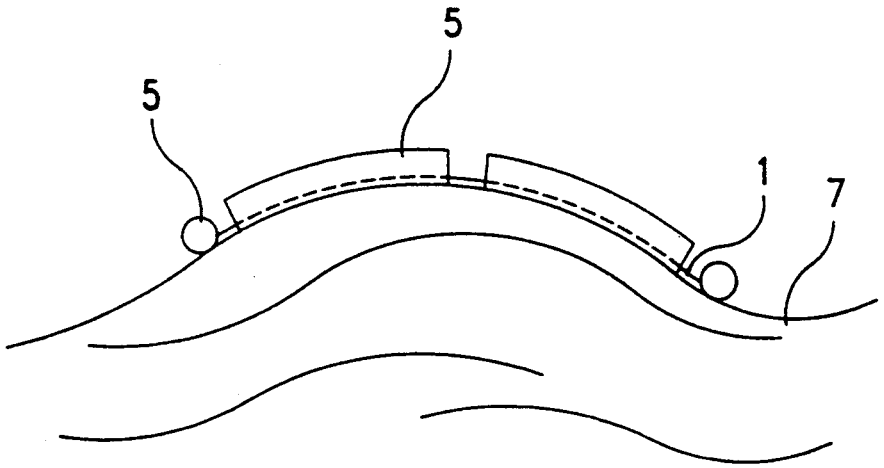
FIG. 3 shows the blanket floated on the water.
Figure 4:
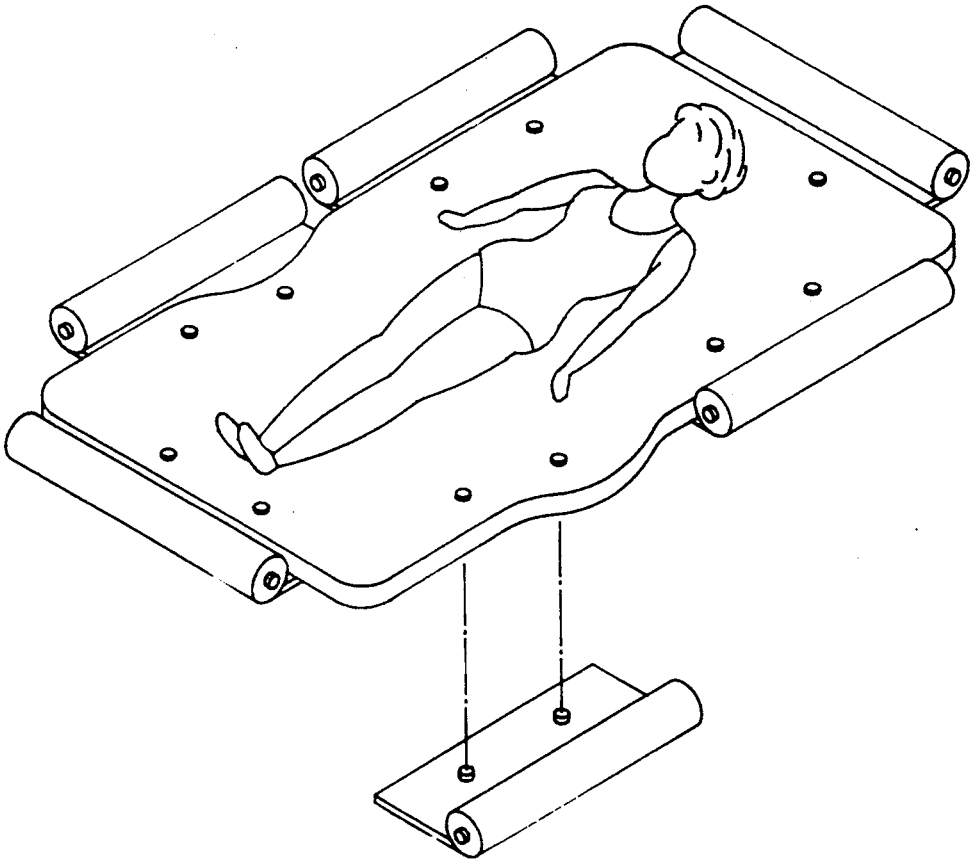
FIG. 4 shows the blanket used for sleeping of a person.

Referring to FIG. 1, a blanket 1 is made from a cellular low density polyethylene in a rectangular shape having a plurality of floats 5 detachably connected to the border thereof. Referring to FIG. 2, each float 5 is made from PVC (polyvinyl chloride) leather in a cylindrical shape, when inflated, having an air valve 6 on one end thereof and a flat connecting board 3 at one side. The flat connecting board 3 has a line of plastic bolts 4 on the top edge thereof. By inserting the plastic bolts 4 into respective holes 2 on the periphery of the blanket 1 from the bottom, a plurality of floats 5 are fastened to the blanket 1 for floating it on the water, and therefore the blanket 1 can be used as a beach mattress or a life preserver (see FIGS. 3 and 4). As the floats 5 were detached from the blanket 1, the blanket 1 can be rolled up for carrying easily or used for keeping the body warm. Because the blanket 1 is soft, it can be closely attached to the surface of the water and will not capsize. Furthermore, the floats 5 provide the blanket 1 with an acute angle cutting through the water in subduing water waves so that the blanket 1 can be stably floating and moving on the water.

What is claimed is:

1. A floatable blanket comprising a rectangular blanket body made from cellular low density polyethylene, and a plurality of cylindrical floats detachably fastened to said blanket around the four sides thereof.

2. The floatable blanket of claim 1 wherein said cylindrical inflatable floats each is made from polyvinyl chloride leather in a cylindrical shape having an air valve on one end thereof and a flat connecting board at one side, the flat connecting board of each cylindrical inflatable float having a plurality of plastic bolts releasably fastened in respective holes on said rectangular blanket body.

* * * * *